US008042233B2

(12) United States Patent
Surratt

(10) Patent No.: US 8,042,233 B2
(45) Date of Patent: Oct. 25, 2011

(54) CUFFBAR

(76) Inventor: Bryan Lamont Surratt, Omaha, NE (US)

( * ) Notice: Subject to any disclaimer, the term of this patent is extended or adjusted under 35 U.S.C. 154(b) by 645 days.

(21) Appl. No.: 12/152,192

(22) Filed: May 13, 2008

(65) Prior Publication Data

US 2008/0289152 A1 Nov. 27, 2008

Related U.S. Application Data

(60) Provisional application No. 60/930,066, filed on May 14, 2007.

(51) Int. Cl.
*A44B 5/00* (2006.01)

(52) U.S. Cl. ..... 24/102 R; 24/102 PL; 24/102 SL; 24/102 FC

(58) Field of Classification Search ..... None
See application file for complete search history.

(56) References Cited

U.S. PATENT DOCUMENTS

| | | | | | |
|---|---|---|---|---|---|
| 29,496 | A | * | 8/1860 | Kubler | 24/105 |
| 322,479 | A | * | 7/1885 | Potter | 24/343 |
| 373,272 | A | * | 11/1887 | Clark | 24/43 |
| 573,217 | A | * | 12/1896 | Younger | 446/413 |
| 872,677 | A | * | 12/1907 | Oyer | 24/544 |
| 1,355,651 | A | * | 10/1920 | Capstraw | 24/102 FC |
| 5,546,641 | A | * | 8/1996 | Radvin et al. | 24/557 |
| D386,076 | S | * | 11/1997 | Moore | D8/394 |
| 6,842,949 | B2 | * | 1/2005 | Warren | 24/135 N |
| D504,576 | S | * | 5/2005 | Strollo | D6/315 |
| 7,308,739 | B2 | * | 12/2007 | Andersen et al. | 24/535 |

* cited by examiner

*Primary Examiner* — Jack W. Lavinder
(74) *Attorney, Agent, or Firm* — Stinson Morrison Hecker LLP

(57) ABSTRACT

A jewelry device, for attachment to a French cuff, convertible cuff or a casual shirt of a type comprising a cuff, a cuff button and a cuff button hole, having a U-shaped frame. A hook shaped arm may connect the U shaped frame around the sleeve cuff. A pair of bars may station the frame, so that it does not become dislodged, offset or pivots from awkward movements. An alternate embodiment uses a removable pin to connect the U shaped frame to the sleeve cuff.

14 Claims, 6 Drawing Sheets

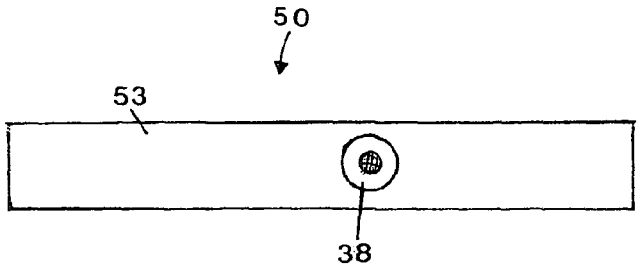
Fig. 3A
Fig. 3B
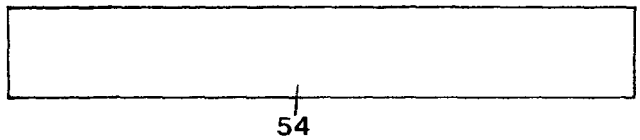
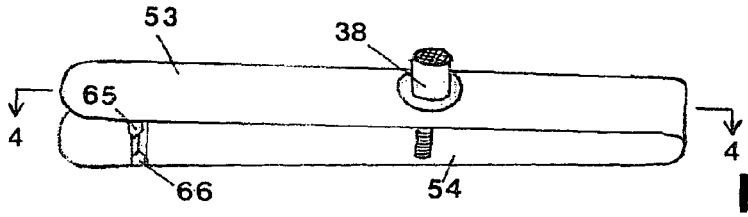
Fig. 3C
Fig. 3D
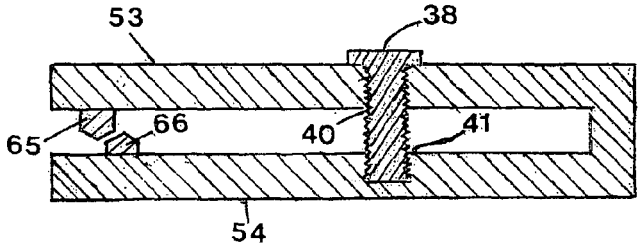
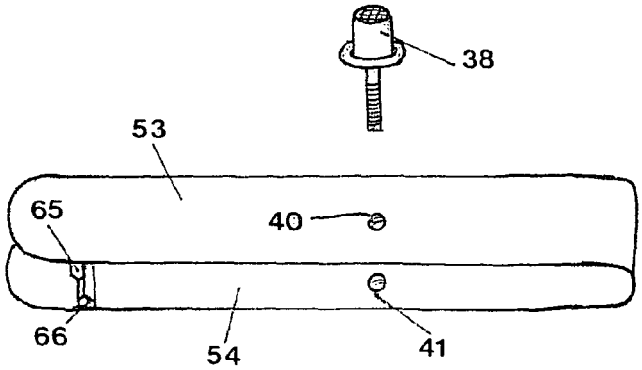
Fig. 3E

CUFFBAR

CROSS-REFERENCES TO RELATED APPLICATION

This application claims the benefit of provisional patent application Ser. No. 60/930,066, filed May 14, 2007. Said U.S. application Ser. No. 60/930,066 is hereby incorporated by reference in its entirety.

BACKGROUND OF THE INVENTION

1. Field of the Invention

This invention relates to clothing accessories. More particularly, the present invention relates to a cuffbar for joining the open edges of a cuff on a French cuff, convertible cuff or a casual shirt of a type comprising a cuff, a cuff button and a cuff button hole. The cuffbar may also serve as a fashionable adornment for the wearer of the shirt.

2. Description of Prior Art

Devices for holding the cuffs of shirt sleeves together are limited to cuff links. These high fashion, elegant devices are expensive and enjoy a monopoly on the fashionable adornment of shirt cuffs.

There are several kinds of cuff links available; however, these cuff holding devices generally comprise a decorative fastener inserted through two button holes of the shirt's cuff i.e. "French cuff" or "convertible cuff".

SUMMARY OF THE INVENTION

It is an object of the present invention to provide a cuffbar that is adaptable to a variety of cuff configurations.

Another object is to provide a cuffbar that serves as fashionable adornment for the wearer of a "French cuff", "convertible cuff" or a casual shirt of a type comprising a cuff, a cuff button and a cuff button hole.

Still further, an additional object is to provide a cuffbar possessing the above capability that can be inexpensively fabricated, thereby encouraging widespread wear.

Briefly, this present invention provides a cuffbar comprising a U shaped bar, a joiner and a pair of stationers. The cuffbar can be attached to shirt cuffs with two button holes, the "double folded cuff" equipped with two button holes and no buttons or the casual shirt of a type comprising a cuff, a cuff button and a cuff button hole i.e. giving the appearance of a French cuff shirt design, by sliding the cuffbar onto the cuff of the wearers' sleeve, passing the cuff through the stationers and closing the joiner, thus causing the cuffbar to stay in position. In a preferred embodiment of the present invention, the joiner is a hinged hook shaped arm positioned perpendicular to the cuffbar. The arm closes around the compressed edges of the wearers' cuffs.

In another embodiment, the joiner is a removable screw pin having an ornamental exterior surface. The removable screw pin is positioned perpendicular to the top leg of the cuffbar The screw pin is received into a spirally grooved cylinder located in the top leg of the cuffbar, then is passed through the cuff button holes and received into a spirally grooved cylinder located in the bottom leg of the cuffbar.

These and other objects and advantages of the present invention will become apparent upon reading the following description of which the attached drawings form a part.

BRIEF DESCRIPTION OF THE DRAWINGS

FIG. 3A is a top plan view of an alternate embodiment of the present invention.

FIG. 3B is a bottom plan view of an alternate embodiment of the present invention.

FIG. 3C is perspective view of an alternate embodiment of the present invention.

FIG. 3D is an enlarged sectional view of an alternate embodiment of the present invention taken in the direction of line 4-4 in FIG. 3C.

FIG. 3E is an exploded view of an alternate embodiment of the present invention.

DESCRIPTION OF THE INVENTION

Figure 1:
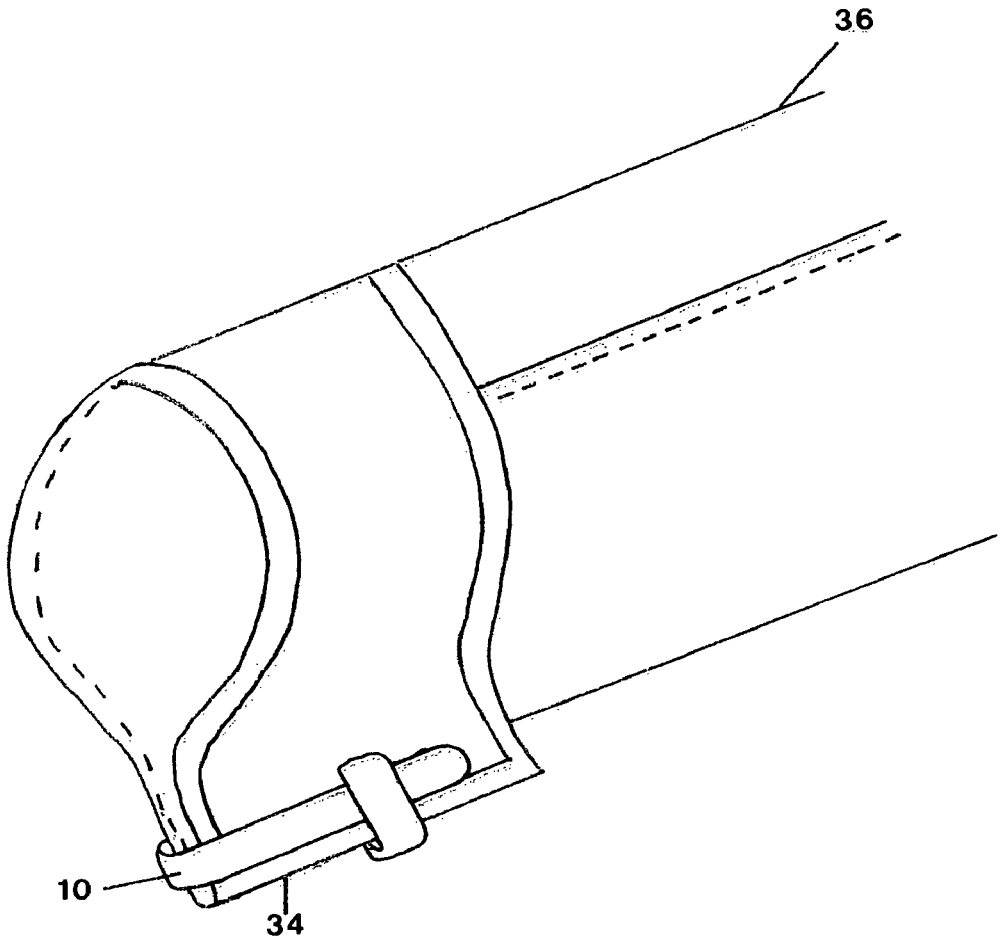
FIG. 1 is a top view showing the preferred embodiment of a cuffbar on a sleeve.

Referring to the drawings, the preferred embodiment comprises a cuffbar generally designated as 10, shaped as a U, with an open end to fit over the compressed edges 34 of a French cuff sleeve 36 of a shirt as illustrated in FIG. 1.

Figure 2A:
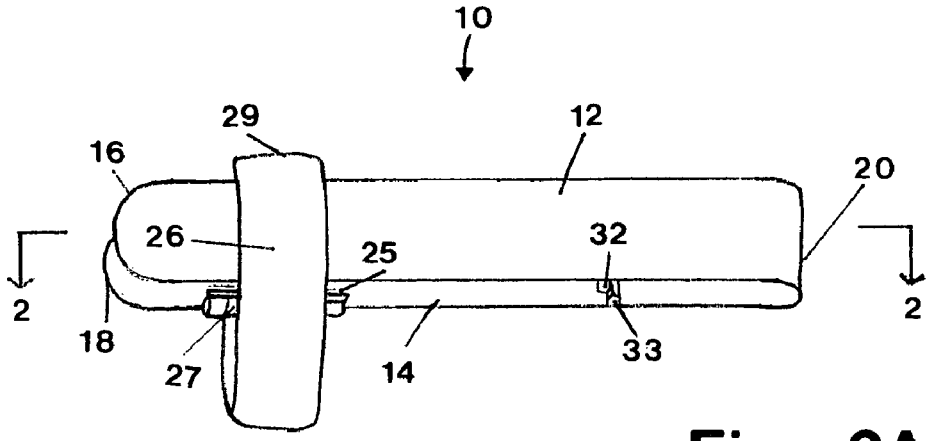
FIG. 2A is a perspective view of the preferred embodiment of the present invention with hook shaped arm closed.
Figure 2B:
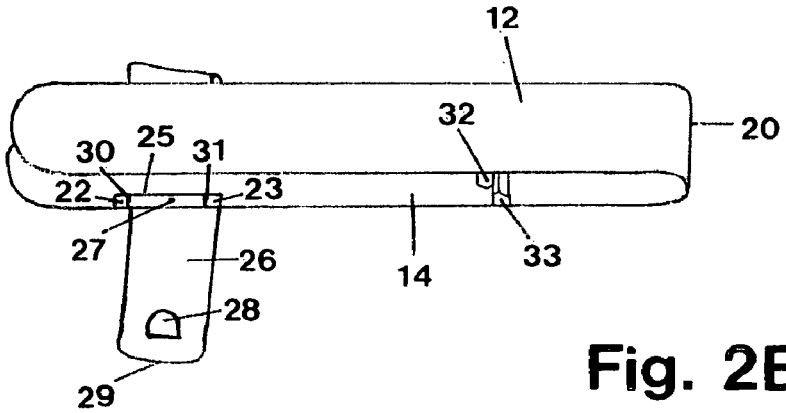
FIG. 2B is a perspective view of the preferred embodiment of the present invention with hook shaped arm open.
Figure 2C:
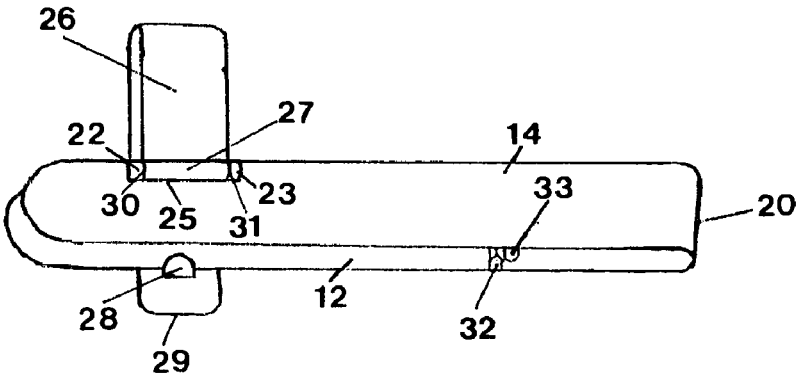
FIG. 2C is a bottom perspective view of the preferred embodiment of the present invention with hook shaped arm closed.

FIG. 2A-FIG. 2C show a perspective view of cuffbar 10. The cuffbar 10 is a U shaped bar formed having a substantially flat first leg 12 and a substantially flat second leg 14. First leg 12 and second leg 14 comprises a distal end 16 and 18 respectively. The proximal ends of first leg 12 and second leg 14 are connected by a bend 20. The first leg 12 and the second leg 14 are generally parallel to each other and matching in thickness. First leg 12, bend 20 and second leg 14 could be unitary or formed as a divided whole.

As can be seen in FIG. 2A, a means for joining is provided for attaching cuffbar 10 to a shirt's cuff. Preferably, the means for joining is provided in the form of a hinge pin 24, hook shaped arm 26 and pin housings 22 and 23. Means for stationing is provided for facilitating the proper orientation of cuffbar 10 with respect to the shirt's cuff. The means for stationing is provided in the form of first bar 32 and second bar 33. First bar 32 and second bar 33 are of a generally triangular configuration.

FIG. 2B shows the cuffbar 10 with the hook shaped arm 26 in the open position. The hook shaped arm 26 has a first end 27 and a second end 29. Pin openings 30 and 31 are disposed on first end 27. A clasp 28 extends perpendicular from a portion inside the peripheral edge of second end 29. Clasp 28 can be of various shapes and sizes.

FIG. 2C shows the bottom of cuffbar 10 with the hook shaped arm 26 in a closed position.

It can be seen that the clasp 28 overlaps the periphery edge of first leg 12, locking the hook shaped arm into position. In particularly, it can be seen that second leg 14 has an indentation 25 formed on its peripheral edge for aligning pin housings 22 and 23. A hinge pin 24 extends through the pin openings 30 and 31 disposed on first end 27 of hook shaped arm 26. The ends of hinge pin 24 extends outwardly from both sides of pin openings 30 and 31, Pin housings 22 and 23 encase the ends of hinge pin 24 for connecting the hook shaped arm 26 to second leg 14. Thus the hook shaped arm 26, having a plane substantially perpendicular to the plane formed by first leg 12 and second leg 14, may be swung around first leg 12 and locked into place with clasp 28. The indentation 25 is provided by cutting out a portion of second leg 14 along one of its' longest periphery edge. The indentation 25 extends longitudinally along one periphery edge of second leg 14 and has a length generally the width of hook shaped arm 26.

Figure 2D:
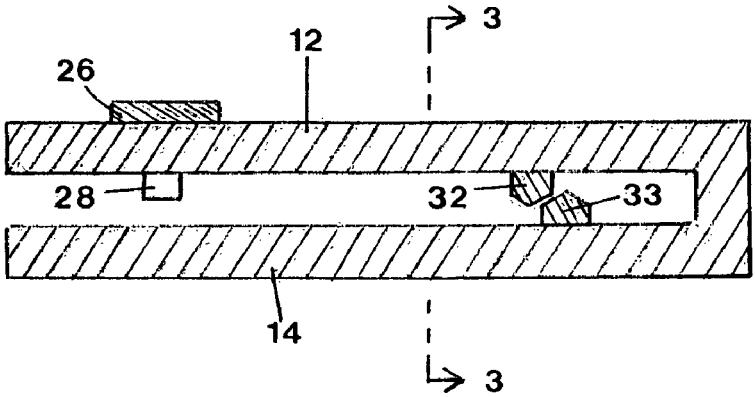
FIG. 2D is a sectional view of the preferred embodiment of the present invention taken in the direction of line 2-2 in FIG. 2A.
Figure 2E:
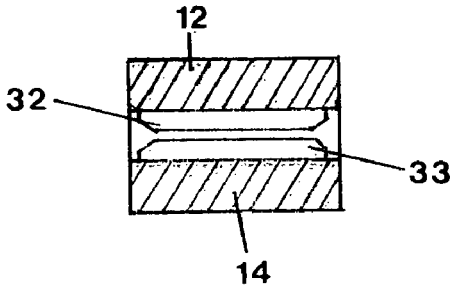
FIG. 2E is a sectional view of the preferred embodiment of the present invention looking forwardly in the direction of line 3-3 in FIG. 2D.

Referring to FIG. 2D in combination with FIG. 2E, cross sectional views of the cuffbar 10, it can be seen that first bar 32 and second bar 33 extend in a direction transverse to that of first leg 12 and second leg 14. First bar 32 extends downward from first leg 12 and second bar 33 extends upward from second leg 14. The first bar 32 and second bar 33 lie adjacent to each other such that they overlap to form an opening which receives the thickness of the compressed edges of a cuff. The overlapping design of first bar 32 and second bar 33 provides a stronger gripping surface that does not become dislodged, offset or pivot from awkward movements.

Importantly, in FIG. 2D, first bar 32 and second bar 33 includes rounded corners. The rounded corners serve to provide smooth travel of the cuffbar 10 onto the shirt cuff and prevent marring of the shirt cuff's material. Between each rounded corner of first bar 32 and second bar 33 is a flat surface. A flat surface of first bar 32 and a flat surface of second bar 33 are positioned adjacent to each other.

Figure 2F:
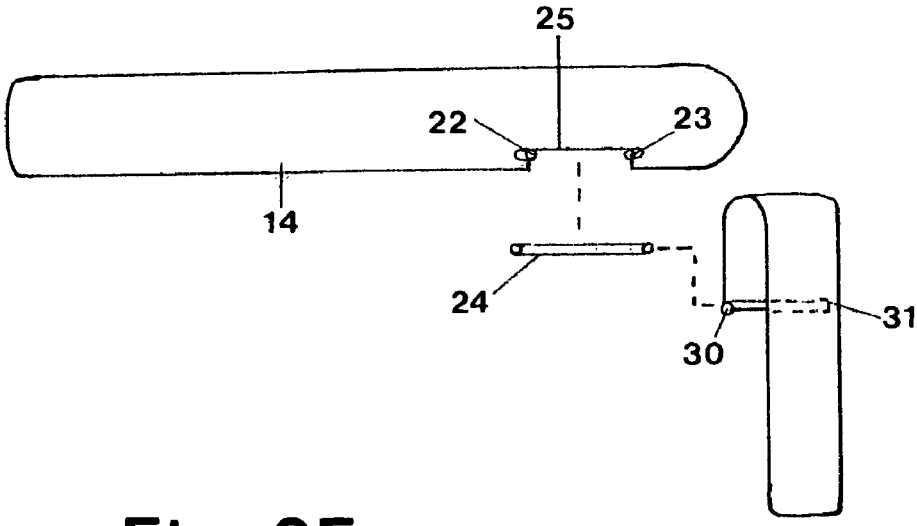
FIG. 2F is an exploded view of the preferred embodiment of the present invention.

FIG. 2F is an exploded rear view of the cuffbar 10 with hinge pin 24 disengaged from the pin housings 22 and 23 on second leg 14 and the pin openings 30 and 31 disposed on send end 29 of hook shaped arm 26. The hinge pin 24 is of generally cylindrical shape and preferably of rigid construction. The pin housings 22 and 23 as well as the pin openings 30 and 31 are of generally the same shape as hinge pin 24.

FIG. 3A-FIG. 3E, show a second alternative embodiment of this invention. FIG. 3A shows a top plan view of the second embodiment of the cuffbar 50 configured with removable screw pin 38 inserted through first leg 53. The placement of screw pin 38 presents a different look than that of the hook shaped arm 26. In FIG. 3B it is shown that the bottom exterior of second leg 54 is free of any functional elements.

In viewing FIG. 3C it can be seen that the means for joining is a removable screw pin 38, which includes a hollow grooved cylinder 40 and 41 constructed and arranged for receiving screw pin 38. In particular, it can be seen that first bar 65 and second bar 66 are affixed near the open end of cuffbar 50.

In order to attach the cuffbar 50 of the embodiment shown in FIG. 3A-FIG. 3E, screw pin 38 is rotated into hollow grooved cylinder 40, inserted through the cuff button hole and rotated into hollow grooved cylinder 41.

FIG. 3D shows a sectional view of the embodiment of the cuffbar 50 as illustrated in FIG. 3C. As can be seen, first leg 53 has a hollow grooved cylinder 40 that extends throughout first leg 53. Importantly, second leg has a hollow grooved cylinder 41 that extends partially through second leg 54. Hollow grooved cylinder 40 allows the screw pin 38 to reach the button holes of a shirts cuff. Hollow grooved cylinder 41 allows the screw pin 38 to tighten onto the cuffbar 50.

FIG. 3E shows an exploded view of the configuration with removable screw pin 38 disengaged from first leg 53 and second leg 54. The head of removable screw pin 38 can be of differing shapes and sizes.

Figure 4:
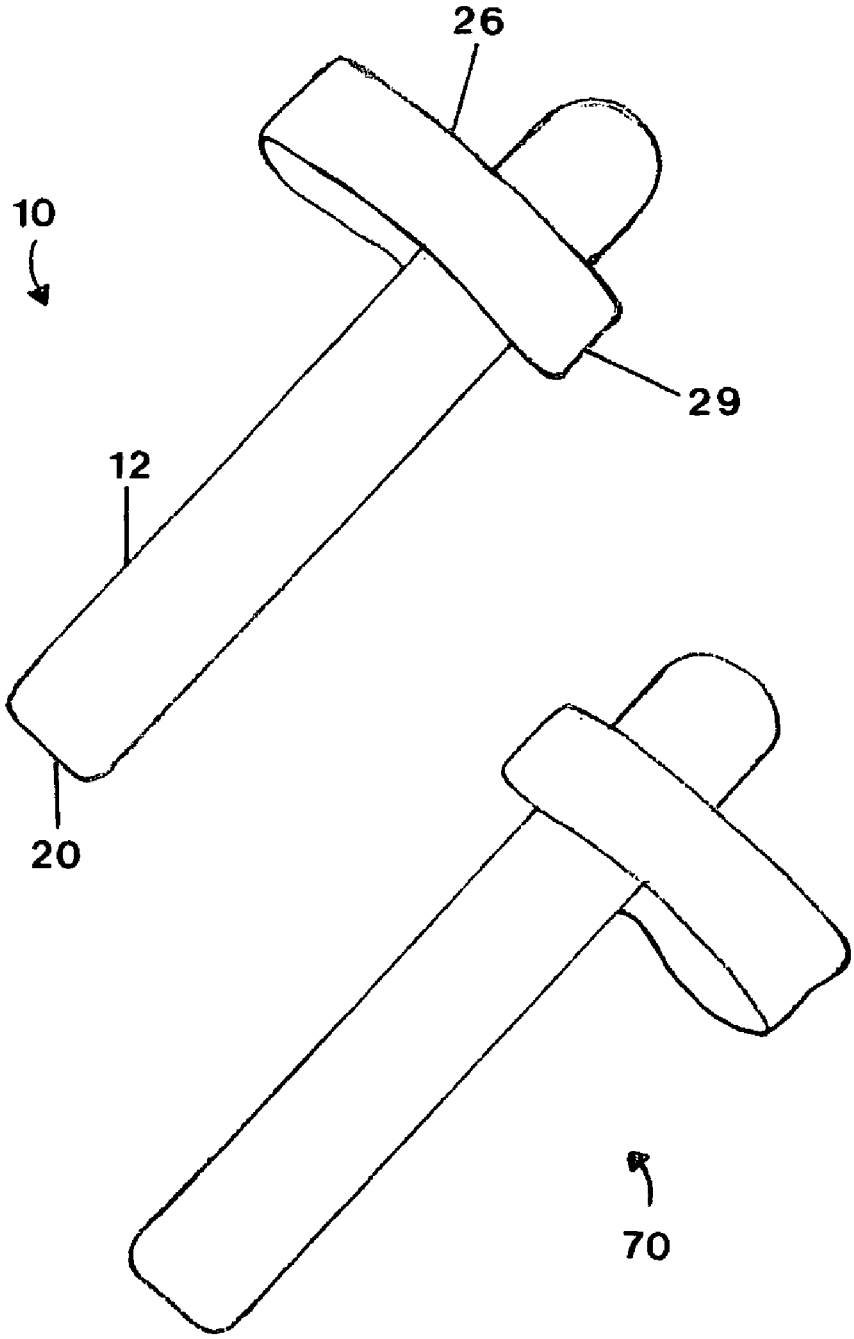
FIG. 4 is a top plan view of the preferred embodiment of a right and left cuffbar of the present invention.
Figure 5:
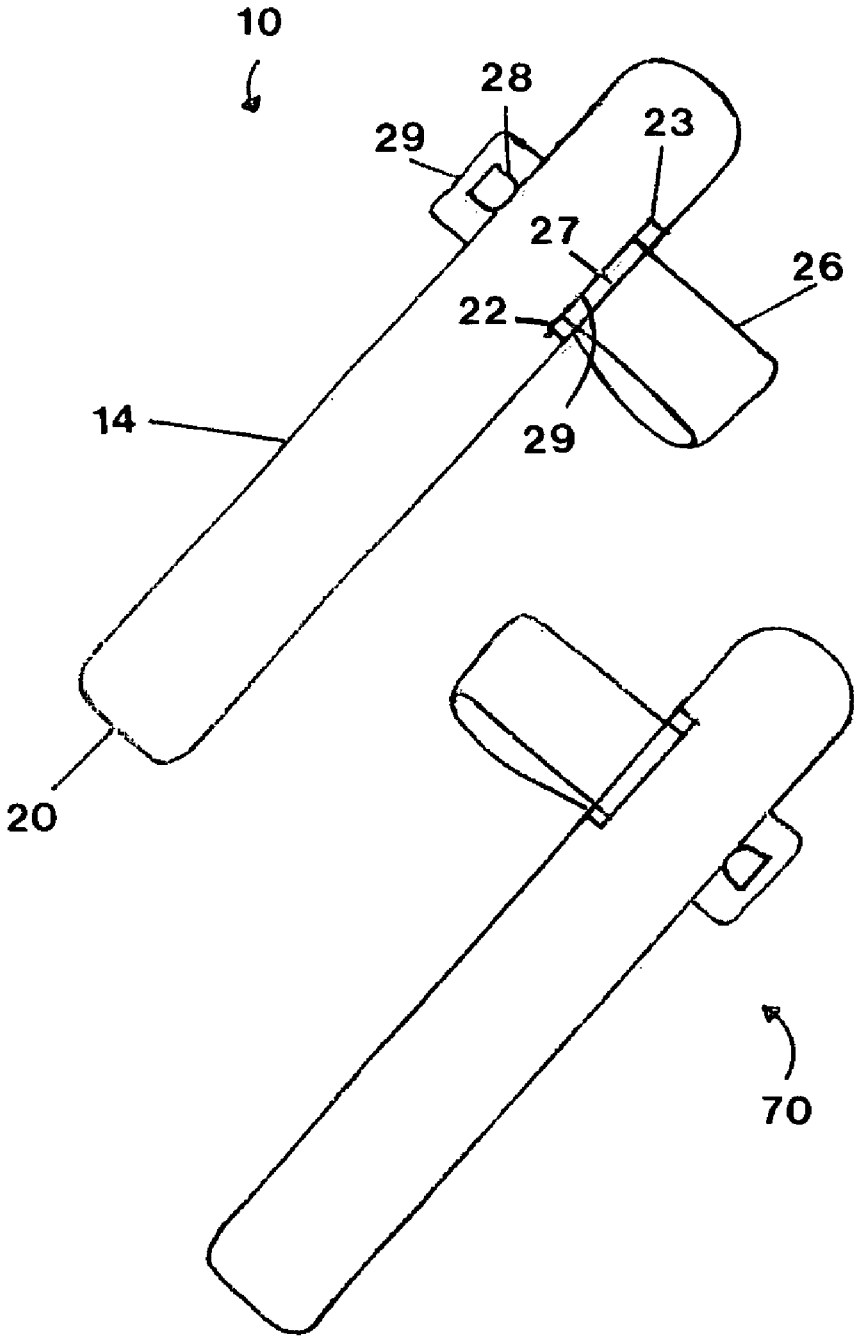
FIG. 5 is a bottom plan view of a preferred embodiment of a right and left cuffbar of the present invention.

FIG. 4 and FIG. 5 illustrate the difference between a left cuffbar 10 and a right cuffbar 70. The bend 20 is designated as the front of the cuffbar 10 and 70. In FIG. 4, looking at the bend 20 head on, for left cuff use, the means for joining is constructed on the left side of cuffbar 10. For right cuff use, the means for joining is constructed on the right side of the cuffbar 10 as seen with cuffbar 70. In FIG. 5, looking at the bend 20 head on, for left cuff use, the means for joining is constructed on the right side of cuffbar 10. For right cuff use, the means for joining is constructed on the left hand side.

All embodiments of this invention can be plated with gold, silver, palladium, or nickel. All embodiments could also be made entirely of solid gold, silver or a white metal casting alloy. All embodiments could also be made out of aluminum which will allow it to be anodized in various colors. Further, being an item of personal adornment, a number of decorative members, such as precious stones and the like can be disposed anywhere on first leg 12 second leg 14, bend 20 hooked shaped arm 26 and screw pin 38. Additionally, the teachings of the invention are applicable to a cuffbar of differing shapes and geometries. Since various materials, finishes, decorations and styles could be used for the present invention, the scope of the present invention should not be limited by such.

What is claimed is:

1. A cuffbar comprising, a) a first leg having a proximal end and a distal end;

b) a second leg having a proximal end and a distal end, said proximal end of said first leg and said second leg connected by a bend such that said first leg is parallel to said second leg;

c) A means for joining said first leg and second leg to a shirt cuff, wherein said means for joining is a hook shaped arm for placing around the cuff edge, said hook shaped arm having a first end and second end, said hook shaped arm having an inside portion; and d) A means for stationing the cuffbar on said shirt cuff, said stationing means disposed on the underside of said first leg and second leg near said distal or proximal end.

2. A cuffbar of claim 1, wherein said first leg, said bend and said second leg are generally equal in thickness.

3. A cuffbar of claim 1, wherein said first end of said hook shaped arm includes openings formed therein, said second end of said hook shaped arm includes a clasp disposed on the inside portion of the hook shaped arm near said second end, said clasp extending perpendicular to plane of second end.

4. A cuffbar of claim 3, wherein said first end includes a hinge pin positioned through said openings, said hinge pin having a right end and left end extending outwardly from said openings.

5. A cuffbar of claim 1, wherein said second leg includes a longitudinal indentation formed along a length of said second leg, said indentation having a length generally the width of said hook shaped arm.

6. A cuffbar of claim 5, wherein said second leg includes pin housings aligned on the left and right ends of said indentation, said hinge pin attached to said second leg.

7. A cuffbar of claim 6, wherein said pin housings includes said right end and said left end of said hinge pin encased therein, said hinge pin pivotally connects said hook shaped arm to said second leg.

8. A cuffbar of claim 7, wherein said hook shaped arm configured for pivoting upward and downward about said hinge pin.

9. A cuffbar of claim 1, wherein said means for stationing is a first bar and second bar wherein said first bar extends in a downward direction from said first leg, said second bar extends in an upward direction from said second leg, said first bar and said second bar being extended in a direction transverse to said first leg and said second leg, said first bar and said second bar having a generally triangular configuration.

10. A cuff bar of claim 9, wherein said first bar and said second bar includes rounded corners, said first bar and said second bar having smooth flat surfaces extending between said rounded corners.

11. A cuffbar of claim 10, wherein said flat surfaces are positioned adjacent to each other.

12. A cuffbar of claim 1, wherein said means for joining is a removable screw pin for attaching to a cuff of a shirt sleeve, said removable screw pin being a spirally grooved solid cylinder, said removable screw pin having an ornamental head design and, wherein said first leg and said second leg include a hollowed grooved cylinder for receiving said removable screw pin.

13. A cuffbar of claim 12, wherein said hollow grooved cylinder of said first leg extends throughout said first leg, and said hollowed grooved cylinder of said second leg extends partially through said second leg.

14. A cuffbar comprising, a) a first leg having a proximal end and a distal end;

b) a second leg having a proximal end and a distal end, said proximal end of said first leg and said proximal end of said second leg connected by a rounded bend such that said first leg is parallel to said second leg;

c) a removable screw pin extending through a hollow grooved cylinder in said first leg and partially through a hollow grooved cylinder in said second leg; and d) at least one bar disposed on an underside of said first leg and said second leg.

* * * * *